United States Patent [19]

Fogle et al.

[11] 4,052,074

[45] Oct. 4, 1977

[54] TWO-SIDE VIEWABLE KALEIDOSYMMETRIC MORPHOLOGICAL PUZZLE GAME

[76] Inventors: James Oliver Fogle; Reiko Iwao Fogle, both of P.O. Box 325, Oceano, Calif. 93445

[21] Appl. No.: 640,314

[22] Filed: Dec. 12, 1975

[51] Int. Cl.[2] ..... A63F 9/08; A63F 9/10

[52] U.S. Cl. ..... 273/157 R; 35/28

[58] Field of Search ..... 273/156, 157 R, 157 A; 35/28; 46/16

[56] References Cited

U.S. PATENT DOCUMENTS

| | | | |
|---|---|---|---|
| 2,353,037 | 7/1944 | Irwin | 273/157 R |
| 3,193,294 | 7/1965 | Irwin | 273/157 R |
| 3,433,485 | 3/1969 | Renn et al. | 273/157 R |

FOREIGN PATENT DOCUMENTS

| | | | |
|---|---|---|---|
| 922,298 | 1/1947 | France | 273/157 R |
| 633,951 | 12/1949 | United Kingdom | 273/157 R |
| 424,477 | 2/1935 | United Kingdom | 273/157 R |

OTHER PUBLICATIONS

Martin Gardner's New Mathematical Diversions From Scientific American, published by Simon & Schuster, New York, 1966, p. 205.

*Primary Examiner*—Anton O. Oechsle
*Attorney, Agent, or Firm*—Townsend and Townsend

[57] ABSTRACT

Puzzle games, comprised of two-sided component puzzle pieces assembled in a tray having a transparent base for viewing both sides of the assembly. The assembly bears a pattern or design which depicts one or more morphologic or other objects exhibiting inter-object or intra-object symmetries. The puzzle pieces have perimetric shapes conforming to symmetric boundaries within the overall pattern or design. Each pattern or design is variegated and some of the pieces may be themselves variegated. At least some of the puzzle pieces are interchangeable with other puzzle pieces in front-to-front, back-to-front, and/or back-to-back relationship to produce a kaleidosymmetric effect. Some morphologic objects bear realistic markings; and some consist of two or more components which may be interchanged with like pieces in other like morphologic objects bearing different realistic markings to create morphologic objects with fanciful markings.

8 Claims, 7 Drawing Figures

TWO-SIDE VIEWABLE KALEIDOSYMMETRIC MORPHOLOGICAL PUZZLE GAME

BACKGROUND OF THE INVENTION

"Tiger, tiger burning bright
In the forests of the night.
What immortal hand or eye
Could frame thy fearful Symmetry?"
*The Tiger,* Wm. Blake Natural symmetry is but one readily observable manifestation of the orderliness of nature, awareness of which is important to an individual's understanding of nature, of himself, and of his place in the cosmos. The present puzzle game is intended to provide a tangible, tactile and optical demonstration or morphologic symmetries occurring in living things, for education and diversion.

The subject matter of the puzzle game of the present invention is not, however, limited merely to living things, but includes non-living naturally occurring objects, such as crystalline formations and the like, as well as man made objects, all for the edification and entertainment of the user.

SUMMARY OF INVENTION

This invention relates to puzzle games in which the naturally occurring interobject and intraobject symmetries of birds, fish, plants, insects, and other objects, and particularly morphological objects, are employed in the creation of puzzle assemblies wherein the puzzle component pieces are cut along borders of symmetry and are interchangeable with some or all other puzzle component pieces, thereby demonstrating and emphasizing the symmetries of nature; wherein the pieces carry morphological designs or design components on opposed surfaces and are interchangeable in front-to-front, front-to-back, and/or back-to-back alignment to produce a multitude of realistic and/or fanciful kaleidosymmetric designs; and wherein the puzzle pieces are assembled in a tray with a transparent base so that both faces of the assembly may be viewed.

Thus, in one embodiment of the invention appearing at FIGS. 1, 3 and 4, a butterfly design is divided into a body, two upper wings, and two lower wings. The two upper wings may be reversed and interchanged within the butterfly; or, they may be interchanged front-to-front, back-to-back, or back-to-front with the upper wings of other butterfly designs divided along like naturally symmetrical borders.

In another embodiment of the invention, as illustrated by the fish puzzle game of FIG. 7, the intraobject symmetries of morphological objects are disregarded. Instead, the objects are depicted to illustrate inter-object symmetries, such as by forming a plurality of like-shaped morphological objects into a puzzle game assembly, each like morphologic object forming a single component puzzle piece thereof, as in Islamic mosaic art works. In the embodiment of FIG. 7, front-to-back parity of the puzzle pieces fails in the like handedness of all pieces; nevertheless, the transparent assembly tray permits the kaleidosymmetric effect of both assembly faces to be observed.

"Kaleidosymmetric" refers to a kaleidoscopic pattern comprised, at least in part, of components exhibiting inter-object or intra-object symmetry.

"Interobject symmetry" refers to repetition of an object or motif such as by translation, reflection, rotation or inversion.

"Intraobject symmetry" refers to symmetrical repetitions occurring within a given object or motif.

DESCRIPTION OF PREFERRED EMBODIMENTS

Figure 1:
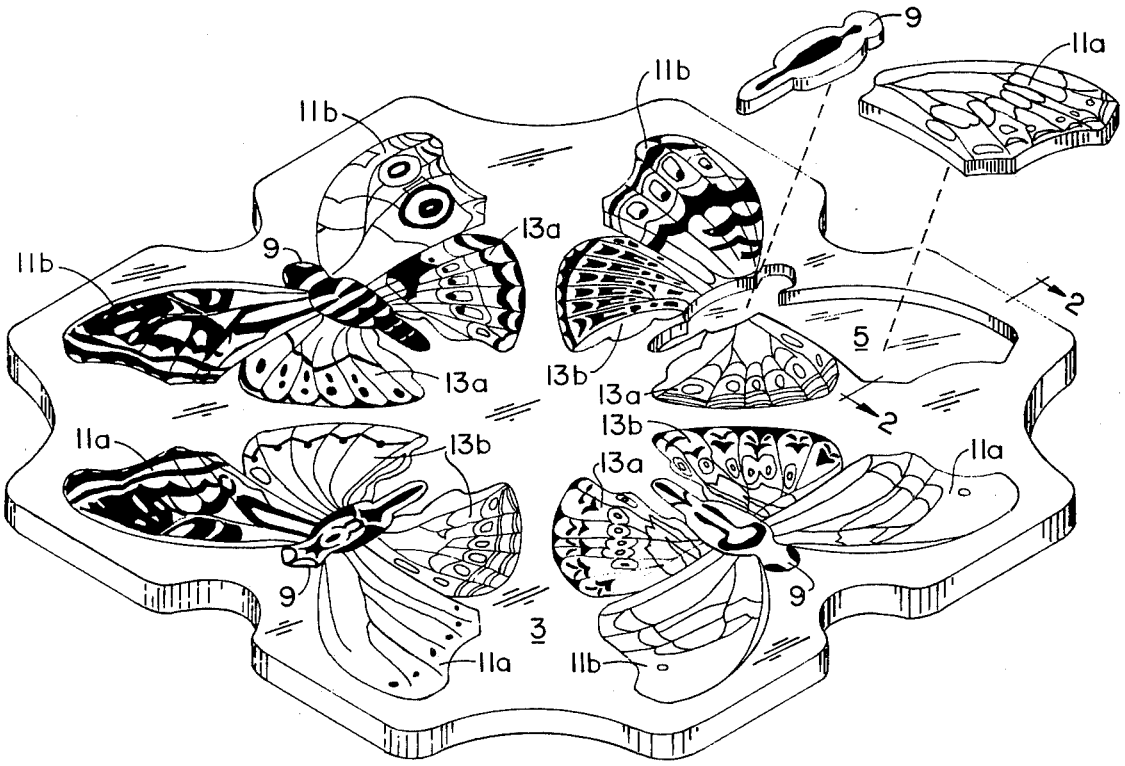
FIG. 1 is an isometric plan view of a butterfly design puzzle game of the present invention, with component pieces interchanged to produce fanciful kaleidosymmetric butterfly designs. Two puzzle pieces of one butterfly are displaced for purposes of illustration.

FIGS. 1–4 illustrate a preferred embodiment of the present invention consisting of a two-side-viewable kaleidosymmetric butterfly puzzle game. Tray 1 consists of an upper stencil-form lamina 3 of wood or the like and a lower transparent lamina 5 forming a base. Four openings 7 in the upper lamina 3 are each in the shape of butterflies. For each butterfly-shaped opening 7, there is provided five interfitting puzzle pieces consisting of a body piece 9, two upper wing pieces 11*a* and 11*b*, and two lower wing pieces 13*a* and 13*b*.

Figure 3:
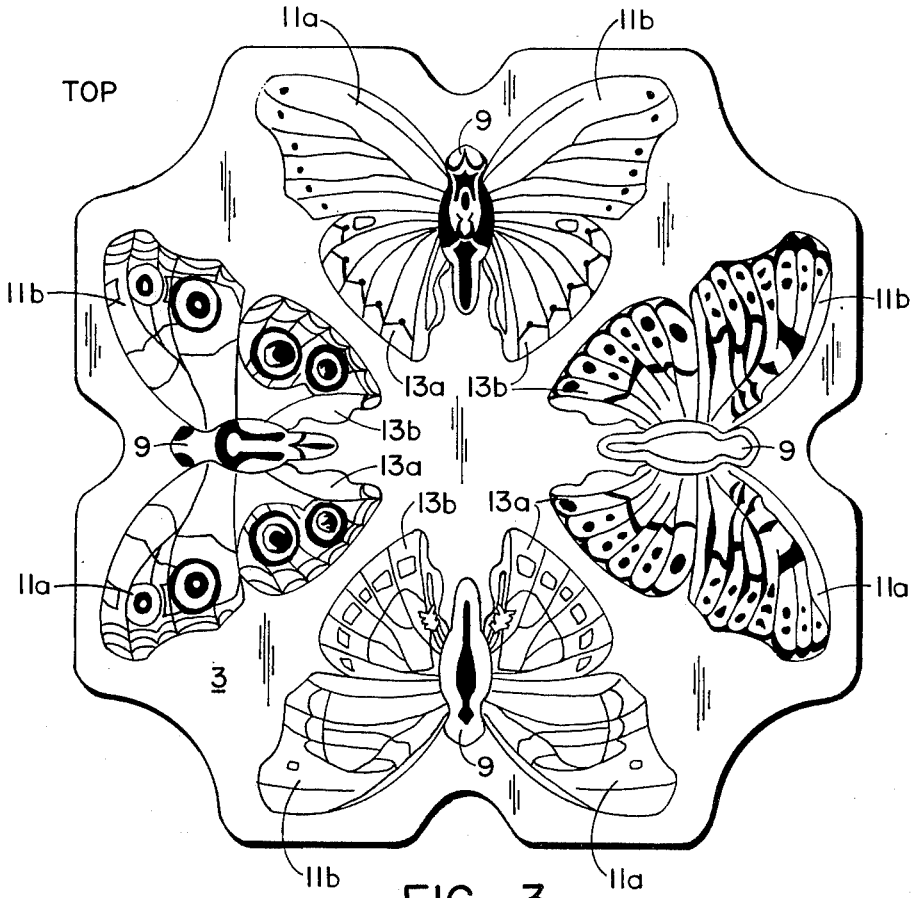
FIG. 3 is a top view of the puzzle game shown in FIG. 1, with all component pieces arranged to depict realistically marked butterflies.
Figure 4:
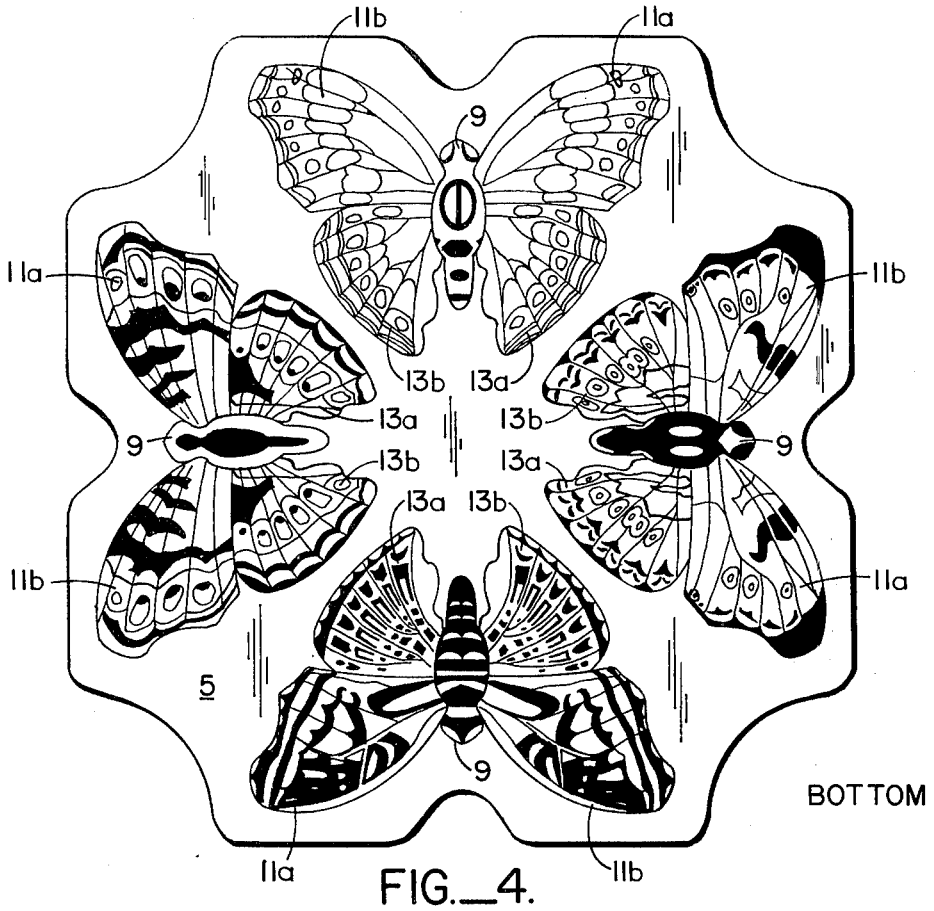
FIG. 4 is a bottom view of the puzzle game of FIG. 3.
Figure 2:
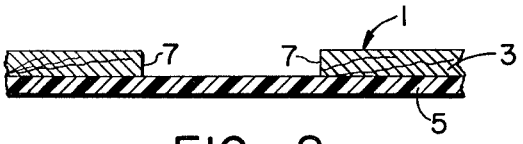
FIG. 2 is a side sectional elevation of the puzzle game of FIG. 1, taken along lines 2—2 thereof.

Each of the puzzle pieces 9, 11*a*, *b* and 13*a*, *b* bears a realistic pattern on its upper and lower surfaces. Thus, the pieces 9, 11*a*, *b* and 13*a*, *b* may be assembled to depict four realistic butterflies on both the upper and lower puzzle surfaces, as shown on FIGS. 3 and 4, respectively. FIG. 4 illustrates the underside of the puzzle pieces illustrated in FIG. 3, as viewed from the transparent base 5.

Every upper wing 11*a*, *b* has the same perimetric configuration as every other upper wing 11*a*, *b*. The same is true of the lower wings 13*a*, *b* and, also, of the bodies 9. Bodies 9 may be reversed (turned face down) and replaced in the same butterfly, or interchanged face up or face down in other butterflies. Similarly, the left upper wing 11*a* of one butterfly may be interchanged with the left upper wing 11*a* of any one of the other three butterflies, or they may be turned face down and interchanged with a right upper wing 11*b* from the same or any other butterfly; and the right upper wings 11*b* are equally interchangeable with one another, or may be reversed and interchanged with any left upper wing 11*a*. The right and left lower wings 13*a*, *b* are likewise interchangeable with other right and left lower wings or reversible and interchangeable with left and right lower wings, respectively.

Thus as shown in FIG. 1, the puzzle pieces 9, 11*a*, *b*, and 13*a*, *b* may be interchanged and/or reversed and/or reversed and interchanged with one another to produce eight butterflies, four on each side, with fanciful markings or patterns.

Accordingly, the puzzle game of FIGS. 1–4 has similar upper and lower designs, each depicting four morphological objects (butterflies), each of which has intraobject bilaterally symmetrical characteristics. The puzzle pieces 9; 11*a, b;* and 13*a, b* have perimetric shapes conforming to intra-object symmetric boundaries. Each assembled face of all single pieces, as well as each butterfly, has a variegated pattern so that the multitude of possible arrangements of the various puzzle pieces gives rise to kaleidosymmetric effects, viewable from top and bottom. Symmetries involved in the butterfly designs include bilateral, point-group, line-group, plane-point, enantiomorphism, and rotational symmetry.

Figure 5:
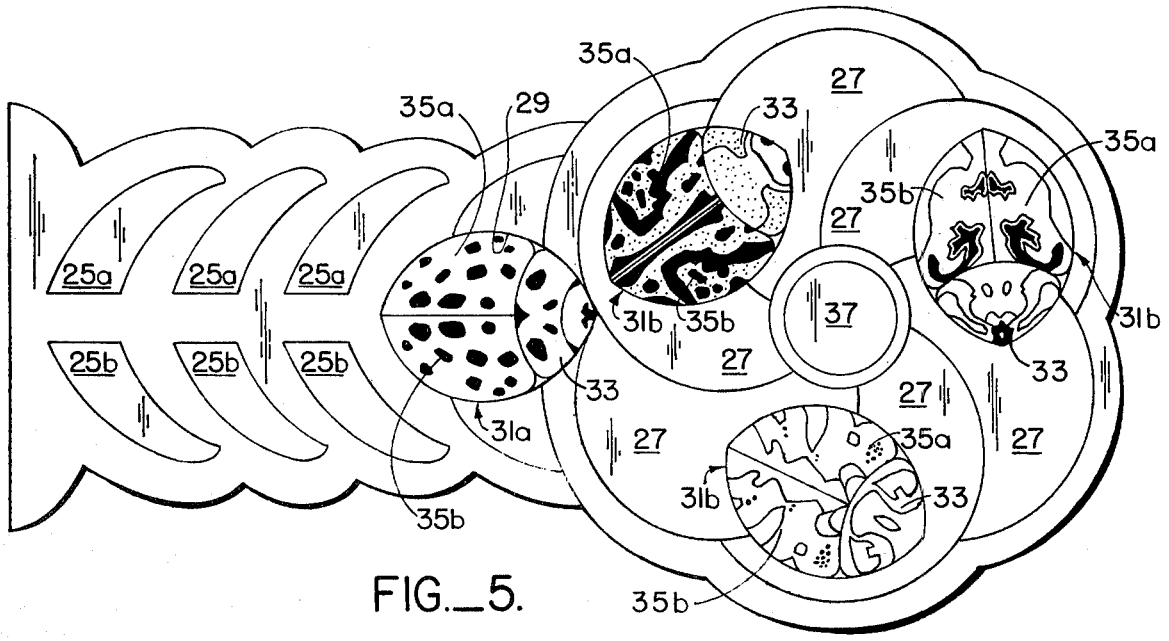
FIG. 5 is a plan view of a beetle and flower puzzle design according to the present invention.
Figure 6:
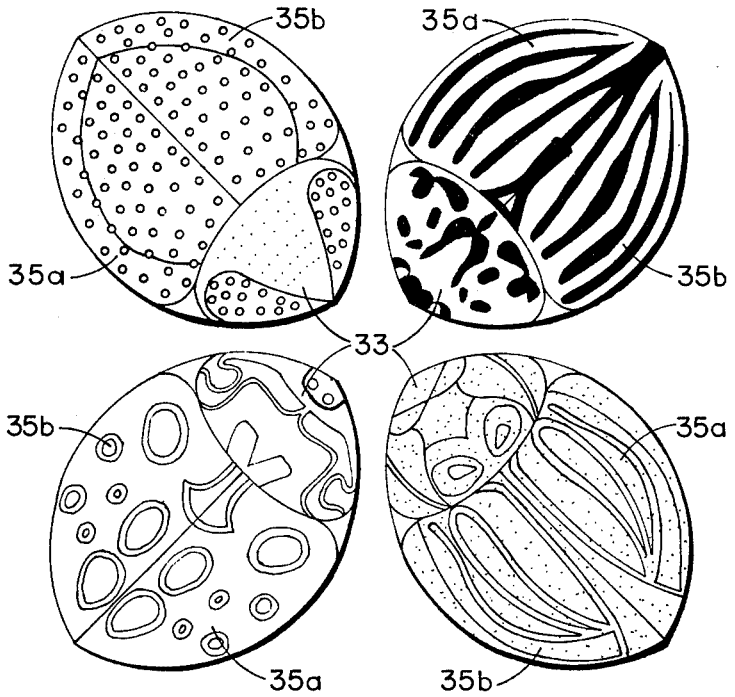
FIG. 6 is a bottom view of the beetle puzzle pieces shown in FIG. 5.

FIGS. 5 and 6 illustrate a second preferred embodiment of the present invention consisting of a two-side-viewable kaleidosymmetric beetle and flower puzzle game. Tray 21 consists of an upper stencil-form lamina 23 and a lower transparent lamina (not shown) forming a base. Openings in the upper lamina 23 are in the shapes of flower leaves 25*a, b,* flower petals 27, and a beetle 29.

The puzzle pieces are comprised of three pairs of left and right handed flower leaves 25*a* and 25*b,* respectively; six flower petals 27; four beetle assemblies 31*a, b,* each consisting of a head piece 33 and two wing pieces 35*a, b;* and a flower center 37. Openings for three of the beetle assemblies 31*b,* and for the flower center 37 are formed in the flower petal pieces 27. All pieces are provided with coloration on both sides. The bottom sides (not shown) of each of the leaves 25 and petals 27 are not variegated. FIG. 6 depicts the variegated undersides of the four beetle assemblies 31*a, b* of FIG. 5.

The left flower leaves 25*a* are interchangeable with each other (translation), or may be reversed or turned face down enantiomorphically and interchanged with right flower leaves 25*b;* and, the same is true of the right flower leaves 25*b*. The flower petals 27 are interchangeable with each other, or they may all be turned face down and interchanged with each other facing down. The beetle assemblies 31*a, b* are all interchangeable with each other face up or face down; and they may be turned head to tail as well. The beetle heads 33 are all interchangeable with each other face up or face down. The left beetle wings 35*a* are all interchangeable with each other face up, or they may be turned faced down and interchanged with other face down left wings 35*a,* or with face up right wings 35*b;* and the same is true of the right wings 35*b*. Flower center 37 may be turned face up or face down.

Thus, the puzzle game of FIGS. 5 and 6 has similar upper and lower designs, each of which consists of a first type of morphological object (flower) exhibiting intraobject bilaterally symmetrical characteristics (stem and leaf portion of flower) and intra-object radially symmetrical characteristics (bloom or petal portion of flower); and four similar second types of morphological objects (beetles), each of which has intra-object bilaterally symmetrical characteristics with enantiomorphic operation. The puzzle pieces 25*a, b;* 27; 33; 35*a, b;* and 37 all have perimetric shapes conforming to intra-object symmetric boundaries. Each assembled face of all puzzle pieces, as well as each beetle assembly 31*a, b,* has a variegated pattern so that the multitude of possible arrangements of the various puzzle pieces gives rise to kaleidosymmetric effects, viewable from top and bottom. Each beetle 31*a, b* may be assembled with either realistic or fanciful markings, depending upon which heads 33 and wings 35*a, b* are associated in a given assembly 31*a, b*.

Figure 7:
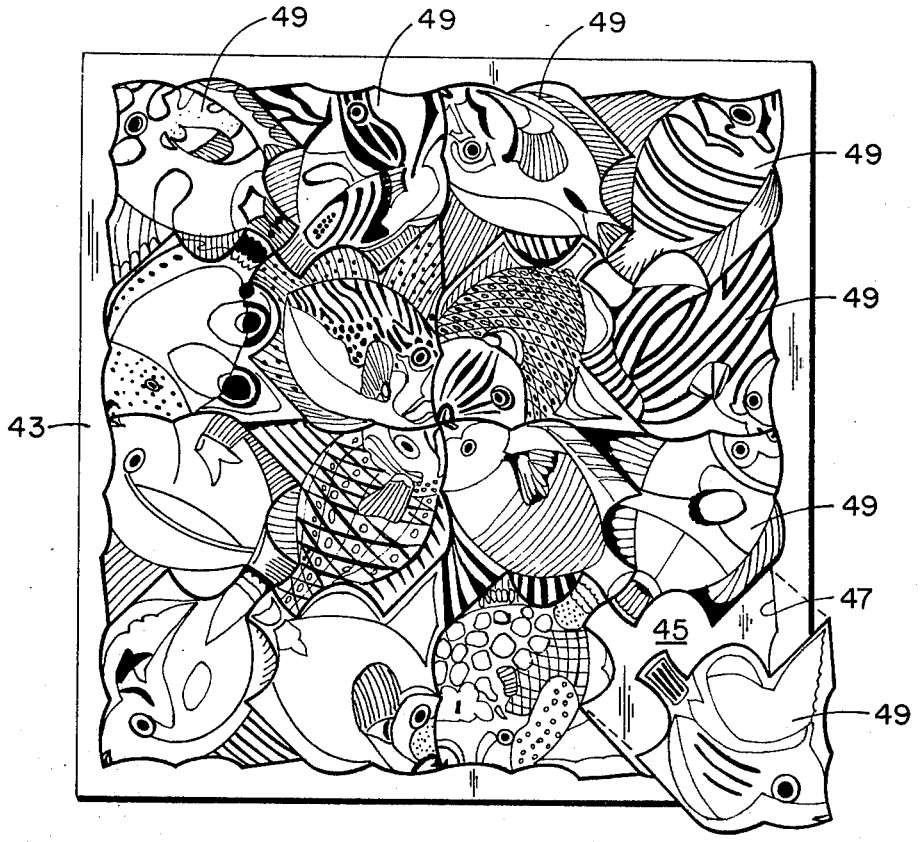
FIG. 7 is a fish puzzle game according to the present invention, with one puzzle piece displaced.

FIG. 7 illustrates a third preferred embodiment of the present invention consisting of a two-side-viewable kaleidosymmetric mosaic fish puzzle game. Tray 41 consists of an upper stencil-form lamina 43 and a lower transparent lamina 45 forming a base. One opening 47 in the upper lamina 43 is generally square, but shaped to accommodate a four-by-four assembly of sixteen mosaic interfitting fish-shaped puzzle pieces 49. Each fish 49 has the same perimetric configuration as each other fish 49; and each fish 49 bears a different realistic pattern on its upper and lower surfaces. Each fish 49 is interchangeable face-up with each other fish 49.

Thus, the puzzle game of FIG. 7 has similar upper and lower designs, each consisting of a four-by-four mosaic of opposite handed morphologic objects (fish 49), each of which has inter-object symmetrical characteristics. The puzzle pieces 49 have perimetric shapes conforming to the inter-object symmetric boundaries. The sixteen piece assembly of fish pieces 49 has a variegated pattern, as does each fish 49, so that the multitude of possible arrangements of pieces 49 gives rise to kaleidosymmetric effects, viewable from top and bottom.

Other perimetric shapes, and other surface patterns therefor may be employed to construct puzzle games without departing from the spirit and scope of the present invention, which is defined in the following claims.

We claim:

1. Two-side viewable puzzle game apparatus comprising a tray for assembly of puzzle pieces thereon, said tray having a transparent base; and a plurality of interfitting puzzle pieces, said puzzle pieces adapted for interfitted arrangements on said tray base to form an assembly having top and bottom faces bearing a design on each of said top and bottom faces, the design on said bottom face being viewable through said transparent base, said designs each depicting a plurality of substantially realistic, differently variegated morphological objects having inter-object or intra-object symmetrical characteristics, said puzzle pieces having perimetric shapes conforming to natural inter-object or intra-object symmetric boundaries of said morphological objects, at least some of said puzzle pieces being interchangeable with puzzle pieces in other of said morphological objects and, also, being reversibly interchangeable with puzzle pieces in the same and other morphological objects, so that said puzzle pieces may be interchanged to produce a kaleidosymmetric effect and demonstrate the symmetries of nature.

2. Two-side viewable puzzle game apparatus as recited in claim 1 wherein said puzzle game pieces have the perimetric configurations shown in FIG. 3 of the drawings.

3. Two-side viewable puzzle game apparatus as recited in claim 2 wherein said puzzle game pieces bear upper and lower surface markings as shown in FIGS. 3 and 4 of the drawings.

4. Two-side viewable puzzle game apparatus as recited in claim 1 wherein said puzzle game pieces have the perimetric configurations shown in FIG. 5 of the drawings.

5. Two-side viewable puzzle game apparatus as recited in claim 4 wherein said puzzle game pieces have upper and lower surface markings as shown in FIGS. 5 and 6 of the drawings.

6. Two-side viewable puzzle game apparatus comprising a tray for assembly of puzzle pieces thereon, said tray having a transparent base; and a plurality of interfitting puzzle pieces adapted for interfitting arrangements on said tray base to form an assembly having top and bottom faces bearing a design on each of said top and bottom faces, the design on said bottom face being viewable through said transparent base, said designs each depicting a plurality of substantially realistic, differently variegated morphological objects having inter-object or intra-object symmetrical characteristics, said puzzle pieces having the perimetric configurations shown in FIG. 7 of the drawings, said puzzle pieces being interchangeable with one another so that said puzzle pieces may be interchanged to produce a kaleidosymmetric effect and demonstrate the symmetries of nature.

7. Two-side viewable puzzle game apparatus as recited in claim 6 wherein said puzzle game pieces have surface markings as shown in FIG. 7 of the drawings.

8. Puzzle game apparatus comprising a tray for assembly of puzzle pieces thereon; and a plurality of interfitting puzzle pieces adapted for interfitted arrangements on said tray to form an assembly, said puzzle pieces having the perimetric configurations shown in FIG. 7 of the drawings and bearing different designs on their surfaces so that said puzzle pieces may be interchanged to produce a kaleidosymmetric effect.

* * * * *